United States Patent [19]

Teichmann et al.

[11] 4,340,315

[45] Jul. 20, 1982

[54] PRINTING AREA COVER PLATE FOR TYPEWRITERS OR LIKE MACHINES

[75] Inventors: Friedrich Teichmann, Feucht; Karl Wenderoth, Bad Vilbel, both of Fed. Rep. of Germany

[73] Assignee: Adlerwerke vorm Heinrich Kleyer A.G., Frankfurt, Fed. Rep. of Germany

[21] Appl. No.: 195,398

[22] Filed: Oct. 9, 1980

[30] Foreign Application Priority Data

Mar. 8, 1980 [DE] Fed. Rep. of Germany ..... 3009001

[51] Int. Cl.[3] ..... B41J 29/08; B41J 29/38

[52] U.S. Cl. ..... 400/690.4; 400/645; 400/694; 400/668

[58] Field of Search ..... 400/644, 54, 693, 694, 400/690.1, 690.4, 693.1, 642, 669, 668

[56] References Cited

U.S. PATENT DOCUMENTS

| | | | |
|---|---|---|---|
| 2,164,227 | 6/1939 | Britten, Jr. | 400/690 |
| 2,807,348 | 9/1957 | Chall et al. | 400/644 |
| 2,950,802 | 8/1960 | Yerks | 400/642 |
| 3,112,228 | 2/1964 | Dollenmayer et al. | 400/690.4 |
| 3,333,671 | 8/1967 | Rohde | 400/646 |
| 3,887,057 | 6/1975 | Stahl et al. | 400/690 |
| 3,901,372 | 8/1975 | Denley | 400/690.4 |
| 3,912,069 | 10/1975 | Faulhaber | 400/690.4 |
| 4,175,878 | 11/1979 | Wing | 400/693 |

FOREIGN PATENT DOCUMENTS

| | | | |
|---|---|---|---|
| 2335582 | 11/1974 | Fed. Rep. of Germany | 400/54 |
| 2731182 | 1/1979 | Fed. Rep. of Germany | 400/642 |
| 2748869 | 5/1979 | Fed. Rep. of Germany | 400/54 |
| 1169616 | 11/1969 | United Kingdom | 400/693.1 |

OTHER PUBLICATIONS

Cassell et al., "Cut Forms Feed Gate", IBM Technical Disclosure Bulletin, vol. 23, No. 3, pp. 903–904, 8/80.

Freeman, "Power . . . Hood", IBM Tech. Discl. Bulletin, vol. 20, No. 12, pp. 5229–5230, 5/78.

*Primary Examiner*—William Pieprz

*Attorney, Agent, or Firm*—Joseph R. Spalla

[57] ABSTRACT

Disclosed is a preferably transparent removably mounted cover plate for covering the top opening or printing point area in a printer, e.g. a needle printer, which serves to reduce noise and to prevent the introduction of foreign substances and dust. Of particular advantage is the inclusion on the cover plate of paper guide elements, a switch actuating cam which acts on a switch to shut off the machine when the cover plate is removed or swung out, and a paper tear-off edge.

3 Claims, 4 Drawing Figures

Fig_1
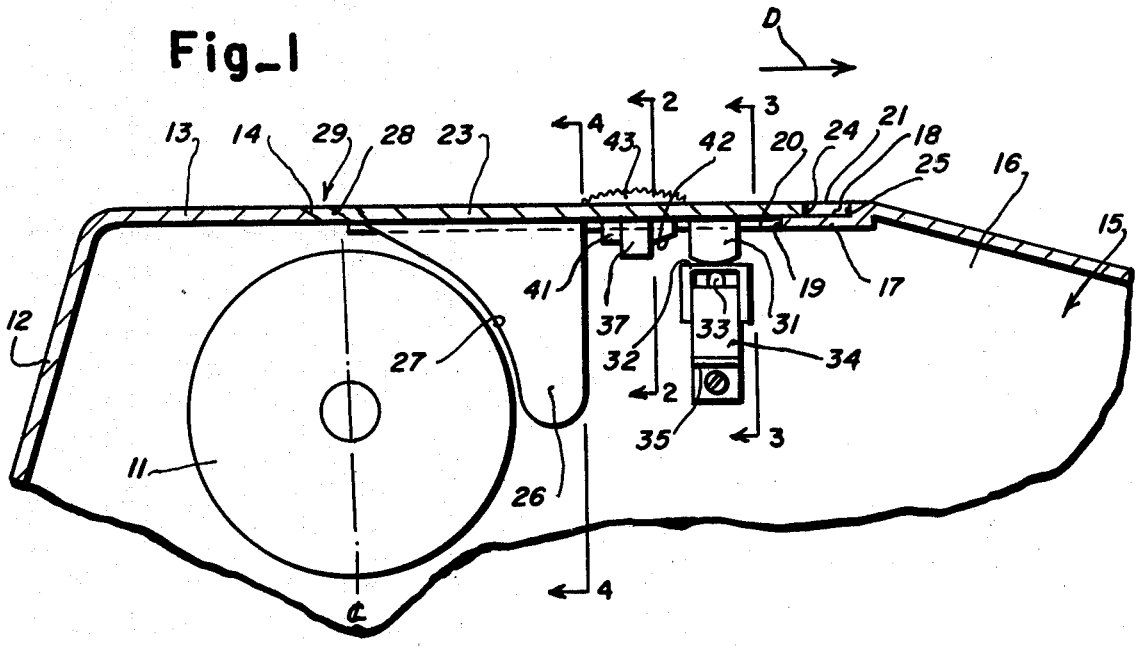
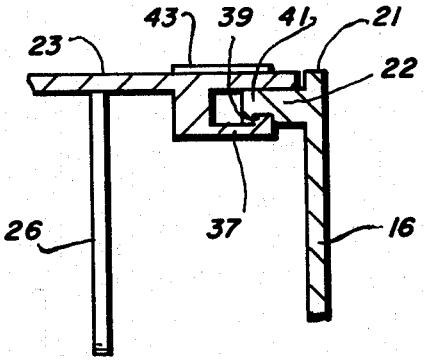
Fig_2
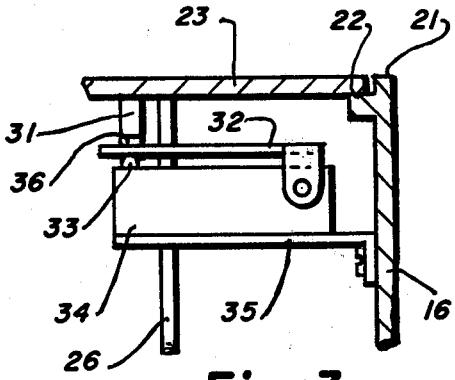
Fig_3
Fig_4
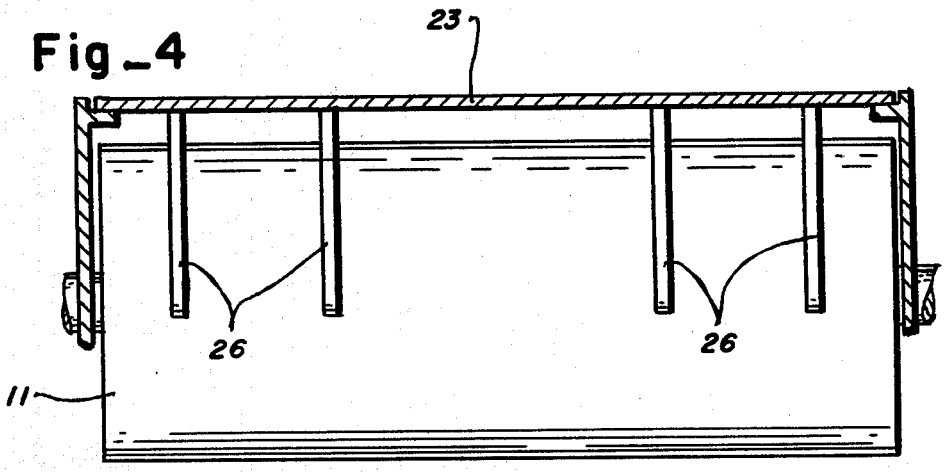

PRINTING AREA COVER PLATE FOR TYPEWRITERS OR LIKE MACHINES

The invention relates to a noise reducing, protective cover plate for printers, typewriters, and similar machines; much particularly it relates to such a cover plate having paper guide structures and safety power switch controls.

A desiderata of the invention is to provide a cover plate, which is simple in design and inexpensive to manufacture, incorporating functional elements which otherwise would have to be separately manufactured and assembled.

In accordance with the invention such a noise reducing protective cover plate incorporates paper guide structure, power switch activating structure and detent structure to effect easy mounting and removal of the cover plate. This structure eliminates the necessity to manufacture and assemble separate paper guide elements, which frequently take the form of rollers mounted on a swing-out bar; provides a safety feature in that a switch actuating cam serves to shut off the machine when the cover plate is removed to service the machine, and eliminate the necessity for separate parts to lock the cover plate to the machine. Another feature is the incorporation on the cover plate of a paper tear-off edge, which is of particular advantage when roll paper is used.

An object of the invention is in the provision of a protective cover plate for reducing noise which is easily mountable and which incorporates functional elements.

Other objects, features and advantages of the present invention will become known to those skilled in the art from a reading of the following detailed description when taken in conjunction with the accompanying drawing wherein like reference numerals designate like or corresponding parts throughout the several views thereof, and wherein:

FIG. 1 is a partial transverse cross sectional view through a machine with a cover plate mounted on a machine;

FIG. 2 is a partial cross sectional view taken along lines 2—2 of FIG. 1 showing the detents locking the cover plate;

FIG. 3 is a partial cross sectional view taken along lines 3—3 of FIG. 1 showing a switch actuating cam in detail; and FIG. 4 is a longitudinal cross sectional view taken along lines 4—4 of FIG. 1.

The embodiment will be described by way of example in a printer; it being understood that it can also be used with the same advantages in typewriters or similiar business machines.

Referring now to FIG. 1 there is shown a printer or like machine wherein a cylindrical platen 11 is supported rearwardly or to the left, as viewed in the Figure, of a printing element e.g. a type disc, (not shown). The machine is provided with a rear casing 12 having a top portion 13 defining a forward facing edge 14 rearwardly of the vertical of the platen 11.

The machine also has a forward casing generally designated by reference 15 having side walls 16 and a recessed top wall 17 defining a support shelf 18 extending across the machine whose rearward facing edge 19 is spaced from the forward facing edge 14 of the rear casing 12 to provide an access opening 20 to the printing element forward of the platen 11. As shown in FIG. 3 the upper edges 21 of the side walls 16 are also internally stepped to provide support shelves 22 coplanar with shelf 18.

As shown in FIGS. 1 and 3 a cover plate 23 is supported on the shelves 18 and 22 of the side 16 and top walls 17 of the forward casing 15 over the access opening 20 and flush with the upper edges 21 of the side walls 16 of the forward casing 15. The forward facing edge 24 of cover plate 23 is spaced from the rearward facing edge 25 of the recessed top wall 17 of the casing 15 to permit, as described below, displacement of cover plate 23 in the direction of arrow D, so that it can be disengaged and lifted from the top casing 15 of the machine.

As it can be seen from FIG. 1 and 4, paper guide elements 26 depending from the underside of the cover plate are molded on plate 23. They are designed as seen from FIG. 4, as spaced cross pieces; the number depending on the length of platen and/or required by the type of paper used in the machine. Edges 27 of the paper guide elements facing platen 11 have a curvature which corresponds to the radius of the platen 11 and taper off toward the rear in an acute angle to cover plate 23. As it can be seen from FIG. 1, paper placed around platen 11 will be guided correctly and safely by the paper guide elements 26.

Cover plate 23 extends rearwardly beyond the vertical centerline of the platen 11, with its rear edge 28 spaced from the forward facing edge 14 of the rear casing 12 to define a paper outlet slot 29. Rear edge 28 of cover plate 23 is sharp and serves as a tear-off edge, so that endless paper, e.g., can be easily torn off. If necessary, edge 28 can also be serrated.

As shown in FIGS. 1 and 3 a switch actuating cam 31 depends from the underside of the cover plate 23 and, in the mounted and locked position of cover plate 23 a shown in FIGS. 1–3, presses against a pivoted switch actuating arm 32 which in turn presses the plunger 33 of a microswitch 34, which is secured on a shelf 35 securred to and extending laterally from the side wall 16 of machine casing 15. Since cover plate 23 is first placed loosely with its lateral and forward edges on shelves 18 and 22 when it is mounted, and must then be displaced to detentably lock it to the casing 15, the bottom edge 36 of switch actuating cam 31 is curved or rounded slightly so that it may cam over the side of switch arm 32.

Referring to FIGS. 1 and 2 there is shown the structure to removably secure the cover plate 23 on the foward machine casing 15. Molded on the underside of the cover plate 23 and depending downwardly and laterally therefrom are resilient fingers 37 which have detents 38 at their ends. In the locked position of cover plate 23, these detents 38 engage depressions 39 of protuberances 41 extending laterally from the shelves 22 of the side walls 16 of the forward machine casing 15. In order to permit locking of detents 38 during movement into the locked position, the protuberances 41 are formed with a bevel 42 as shown in FIG. 1. In order to facilitate the forward locking and backward unlocking movement of cover plate 23, finger grips 43 designed as grooved bulges are formed on the top of the cover plate 23 above the resilient fingers 37 and detents 38.

To insert new paper or for changing the type body in a typewriter, it suffices to push cover plate 23 by means of finger grips 43 in the direction of arrow D. The cover plate 23 can then be lifted from top casing 15. Cover plate 23 is mounted into its operating position in reverse order and is locked by the detents 38 as shown in FIG. 2. For completeness' sake it should be pointed out that finger grips 43 and resilient fingers 37 are arranged on both sides of cover plate 23. This also applies to protuberances 41, which are provided on both sides 16 of top casing 15.

The invention also contemplates an embodiment wherein the cover plate 23 is pivotally mounted on the top casing 15. In such an embodiment case a slightly different design of detents 38 would be necessary.

It can be seen from the foregoing considerations, as well as from the drawing that cover plate 23 not only serves as a noise suppressor and as a barrier against the penetration of foreign substances and dust, but also serves as a paper guide and safety power cut off actuator to ensure that the machine is shut off when cover plate 23 is removed. In incorporating these functions considerable manufacturing savings are realized. When used in printers, typewriters etc. a cover plate 23 of transparent plastic material can be molded as a unit with all the above described elements.

The invention claimed is:

1. In a typewriter or like machine having a platen and a top casing defining an access opening to the printing area forward of said platen, said top casing having side walls supporting a power on-off switch and detent structure, a cover plate removably mounted on said top casing for closing said access opening except for a paper exit slot substantially opposite the vertical center line of said platen, said cover plate having detent structure depending therefrom complimentary to the detent structure on said top casing, said mounted cover plate being slidably movable relative to said top casing between a detented locked position and an unlocked removable position, said complimentary detent structures on said top casing and said cover plate being engaged and disengaged when said cover plate is moved from unlocked to locked position and from locked to unlocked position respectively, said cover plate including means for facilitating sliding movement of said cover plate between locked and unlocked positions, said cover plate having switch actuating means depending therefrom for slidingly engaging and actuating said power on-off switch to on position incident to movement of said mounted cover plate to locked position, and to off position incident to movement of said cover plate to unlocked position, said cover plate further having on its underside a plurality of depending paper hold down guides spaced along the axis of said platen extending from said exit slot forwardly of said platen in planes perpendicular to said platen and having edges facing and spaced from said platen whose curvature follows the curvature of said platen, and said cover plate at the edge thereof defining said exit slot having an acute angle.

2. In a typewriter as recited in claim 1, said top casing having recessed shelves defining said access opening for supporting said cover plate flush with said top casing.

3. In a typewriter as recited in claim 1, said cover plate being a single piece molded plastic.

* * * * *